United States Patent [19]

Malacheski et al.

[11] 4,043,159

[45] Aug. 23, 1977

[54] PADLOCK CONSTRUCTION

[76] Inventors: Joseph J. Malacheski, 28 E. Division St.; Richard J. Zenda, 21 O'Neill Ave., both of Wilkes-Barre, Pa. 18702

[21] Appl. No.: 739,068

[22] Filed: Nov. 5, 1976

[51] Int. Cl.[2] ..... E05B 67/22

[52] U.S. Cl. ..... 70/38 R; 70/38 C; 70/53

[58] Field of Search ..... 70/38 R, 38 A, 38 B, 70/38 C, 39, 53, 35

[56] References Cited

U.S. PATENT DOCUMENTS

| | | | |
|---|---|---|---|
| 1,487,258 | 3/1924 | Menger | 70/38 C |
| 1,527,336 | 2/1925 | Voda | 70/39 |
| 1,597,560 | 8/1926 | Wise | 70/38 C |
| 1,719,309 | 7/1929 | Radosevic | 70/38 C |

*Primary Examiner*—Robert L. Wolfe
*Attorney, Agent, or Firm*—Robert K. Youtie

[57] ABSTRACT

A padlock construction including a body having tine-receiving holes and a shackle having tines insertable in the holes, wherein the body is provided internally with tumbler pins shiftable into and out of intersecting relation with a tine to lock the latter, the padlock body having a slot affording end access to the tumblers to shift the latter out of tine-intersecting relation to open the lock.

9 Claims, 9 Drawing Figures

FIG. 3
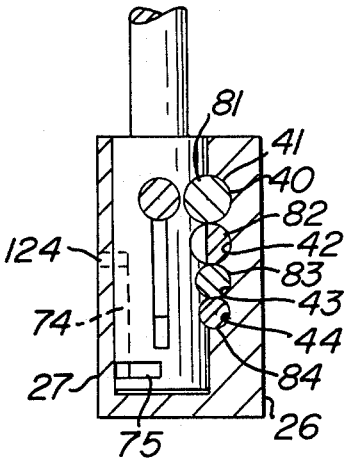
FIG. 4
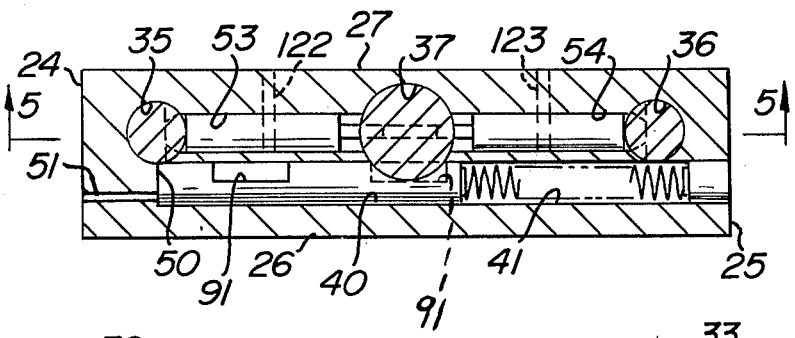
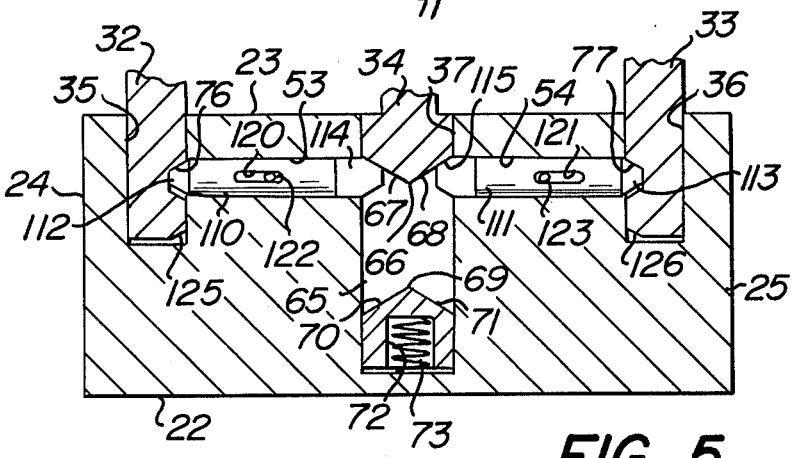
FIG. 5
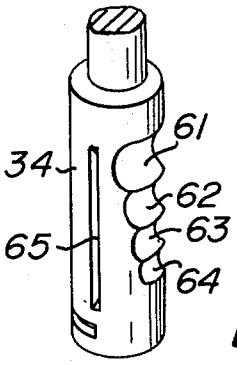
FIG. 7
FIG. 8
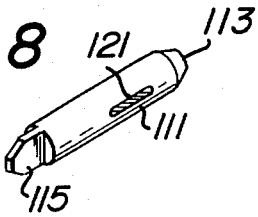
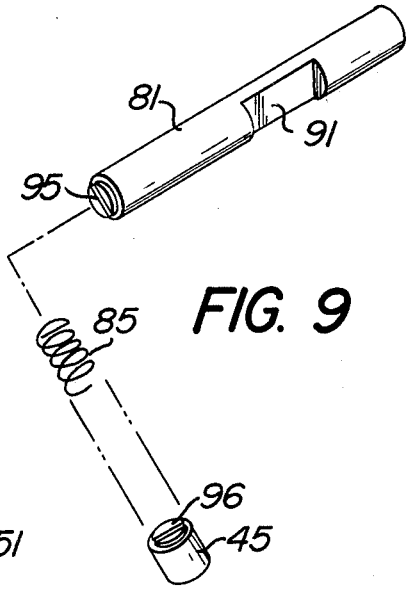
FIG. 9
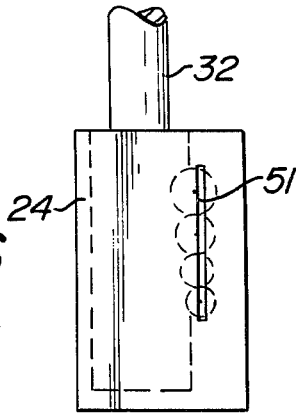
FIG. 6

PADLOCK CONSTRUCTION

BACKGROUND OF THE INVENTION

While the field of padlocks is very highly developed, certain conventional features of padlocks remain unsatisfactory. For example, the high cost of keys for conventional cylinder-type locks results from the need for slow and tedious key cutting operations, and the concomitant requirement that such keys be fabricated of relatively expensive material, such as brass or aluminum. Of course, the manufacture of cylinder plugs for conventional cylinder locks is costly, both for tooling and finishing.

SUMMARY OF THE INVENTION

It is, therefore, an important object of the present invention to provide a padlock construction which overcomes the above-mentioned difficulties, permits of economic mass production of keys from relatively inexpensive ferrous materials by simple and inexpensive, mass production procedures.

It is another object of the present invention to provide a highly improved padlock construction which comletely eliminates the need for a cylinder plug to reduce the number of parts and effect substantial savings in cost.

It is still another object of the present invention to provide a padlock construction of the type described wherein may be incorporated a three-tined shackle for greatly enhanced security, and enabling greater versatility in use.

Still another object of the present invention resides in the provision of a padlock construction having the advantageous characteristics mentioned in the preceding paragraphs, wherein tampering is more effectively prevented, as by substantially precluding picking, and further by the provision of staunch and sturdy, positive detent means.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 3 is a sectional elevational view taken generally along the line 3—3 of FIG. 1.

FIG. 4 is a horizontal sectional view taken generally along the line 4—4 of FIG. 1.

FIG. 5 is a longitudinal sectional view taken generally along the line 5—5 of FIG. 4.

FIG. 6 is an end elevational view, as taken along the line 6—6 of FIG. 1.

FIG. 7 is a partial perspective view showing one tine of the instant shackle, apart from the remainder of the lock.

FIG. 8 is a perspective view showing one detent element or pen of the present invention apart from the remainder of the lock.

FIG. 9 is an exploded perspective view showing a tumbler of the present invention apart from the remainder of the lock.

DESCRIPTION OF THE PREFERRED EMBODIMENT

Figure 1:
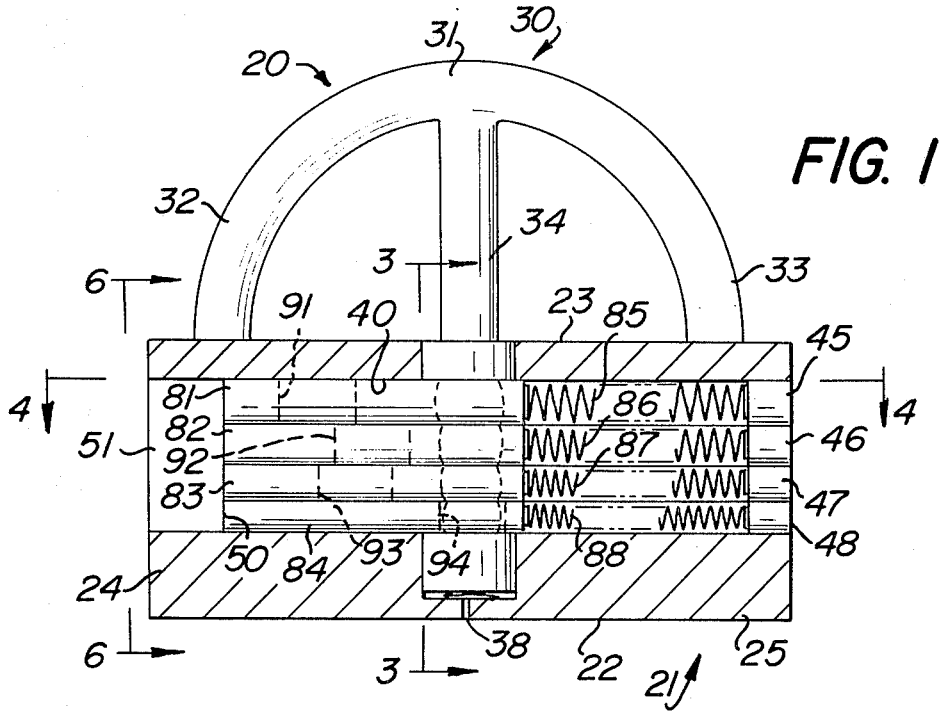
FIG. 1 is a longitudinal sectional elevational view showing a padlock construction of the present invention, illustrating interior mechanism thereof in locked condition.

Referring now more particularly to the drawings, and specifically to FIG. 1 thereof, a padlock is shown therein and generally designated 20, the padlock including a lock body 21, which may be of block-like generally rectangular configuration, say having parallel lower and upper surfaces 22 and 23, parallel opposite end surfaces 24 and 25, and parallel opposite side surfaces 26 and 27 (see FIGS. 3 and 4). A shackle, generally designated 30, may be insertable and withdrawable with respect to the lock body, as for locking and unlocking relation relative thereto.

The shackle 30 of the present invention includes a bight region 31, and a plurality of generally parallel tines or prongs extending from the bight region, being preferably three in number. Thus, the shackle 30 may include a pair of outer prongs or tines 32 and 33, and an intermediate prong or tine 34, all of which tines may be generally parallel and substantially coplanar.

The lock body 21 is formed in its upper side with a plurality of downwardly or inwardly extending tine receiving openings or holes arranged in substantially parallel, coplanar relation. In particular, a pair of outer, generally parallel tine-receiving openings or holes 35 and 36 may extend downwardly or inwardly through the upper body surface 23 into the interior of the body, respectively adjacent to and spaced inwardly from body end walls 24 and 25. Spaced mediately between the tine-receiving holes 35 and 36 may be an additional intermediate tine-receiving hole 37, extending downwardly or inwardly through the upper lock body surface 23, generally parallel to the outer tine-receiving holes 35 and 36. The outer tine-receiving holes 35 and 36 are generally cylindrical to conformably receive the outer tines 32 and 33, and the intermediate tine-receiving hole 37 may also be generally cylindrical, and of greater diameter and depth to receive the intermediate tine 34, which is of greater diameter and length than the outer tines. Also, the intermediate tine-receiving hole 37 may be provided in its lower end with a seepage or drain hole 38 communicating between the lower interior region of the tine-receiving hole, and exteriorly of the padlock body through the lower body surface 22.

As noted, the body holes 35, 36 and 37 may be generally coplanar, and as best seen in FIG. 4 may have their center lines in a longitudinal plane of the lock body. Offset forwardly of the plane of tine-receiving holes 35, 36 and 37, is a tumbler-containing cavity 40, lying essentially in a plane parallel to the plane of the tine-receiving holes. Specifically, the tumbler-containing cavity 40 maybe offset forwardly from the centerline plane of tine-receiving holes 35, 36 and 37, say being offset sufficiently to avoid intersection with the smaller outer tine-receiving holes 35 and 36, but insufficiently to avoid intersection with the larger, intermediate tine-receiving hole 37. This intersection is best seen in FIGS. 3 and 4.

In FIG. 3 it will be seen that the generally longitudinally extending tumbler-containing cavity 40 is composed of a generally vertically aligned row or series of generally horizontally extending cylindrical cavity regions 41, 42, 43 and 44. The several cylindrical cavity regions 41–44 may lie in adjacent, superposed tangential relation so as to open vertically into one another. Further, the several cylindrical cavity regions 41–44 may each be of different size or cylindrical diameter, see FIG. 3.

The several cylindrical cavity regions 41–44 may extend in one direction, toward end wall 25, through the latter end wall, there being respectively closed by closure members or plugs 45, 46, 47 and 48. As noted, the several cylindrical cavity retions 41–44 are in vertically, superposed, tangential alignment, their center lines being generally coplanar. These cylindrical cavity regions remote from the body end wall 25 terminate short of the body end wall 24 in an end wall 50, see FIGS. 1 and 4. A generally rectangular, vertically disposed passageway or slot 51 may extend longitudinally inwardly through the body end wall 24 and open through the tumbler-containing cavity end wall 50 into the tumbler-containing cavity. The slot 51 is relatively narrow, as compared to the width of tumbler-containing cavity 40, and offset forwardly toward the front body surface 26 out of the centerline plane of cylindrical cavity regions 41–44, which relationship is best seen in FIGS. 4 and 6.

The lock body 21 is further formed, in the centerline plane of tine-receiving holes 35–37, and spaced from the plane of tumbler-receiving cavity 40, with a pair of longitudinally aligned, generally cylindrical passageways or bores 53 and 54 extending from holes 35 and 36, respectively, laterally inwardly toward and opening into hole 37 on opposite sides thereof. This construction and arrangement of passageways 53 and 54 is best seen in FIGS. 4 and 5.

The intermediate tine 34 of the shackle 30 is formed on one side, see FIG. 7, with a plurality of generally semicylindrical cutouts or recesses 61, 62, 63 and 64, all of which face forwardly toward and open into the tumbler-containing cavity 40. More specifically, the several recesses or cutouts 61–64 are of generally semicylindrical configuration, with their several centers of curvature substantially coplanar with the center lines of the several cylindrical cavity regions 41–44. Thus, where the tumbler-containing cavity 40 intersects with and opens into the tine-receiving hole 37, the cutouts 61, 62, 63 and 64 combine, respectively, with the adjacent cavity regions 41, 42, 43 and 44 to define continuous cylindrical bores.

The intermediate tine 34 may be formed with a through cut or slot 65 opening laterally through opposite sides of the tine, and lying in a plane spaced from the cutouts 61–64. The through slot 65 is shown in FIG. 5 as having its upper end terminating in an angulate or downwardly tapering end wall 66 including a pair of oblique, downwardly convergent surfaces 67 and 68. The through slot 65 terminates at its lower end in an upwardly tapering or angulate end wall 69 defined by a pair of upwardly convergent oblique surfaces 70 and 71. The lower end of tine 34 may be recessed, as at 72, to receive a coil compression spring 73 resiliently urging the intermediate tine, and consequently the shackle 30, upwardly toward an unlocked condition.

Further provided in the intermediate tine 34, diametrically opposed to the cutouts 61–64, may be a vertical slot 74, terminating at its lower end in a generally quadrant-shaped slot 75, see FIG. 3.

The outer tines 32 and 33 are each provided on its inner side with a generally conical recess or bore as at 76 and 77, see FIG. 5. In the locked position of shackle 30, as shown in FIG. 5, the conical recesses 76 and 77 are each generally aligned with and opening into an outer end of a respective bore 53, 54. Also, the bores 53 and 54 are located so as to open into the upper end of slot 65, on opposite sides thereof.

Figure 2:
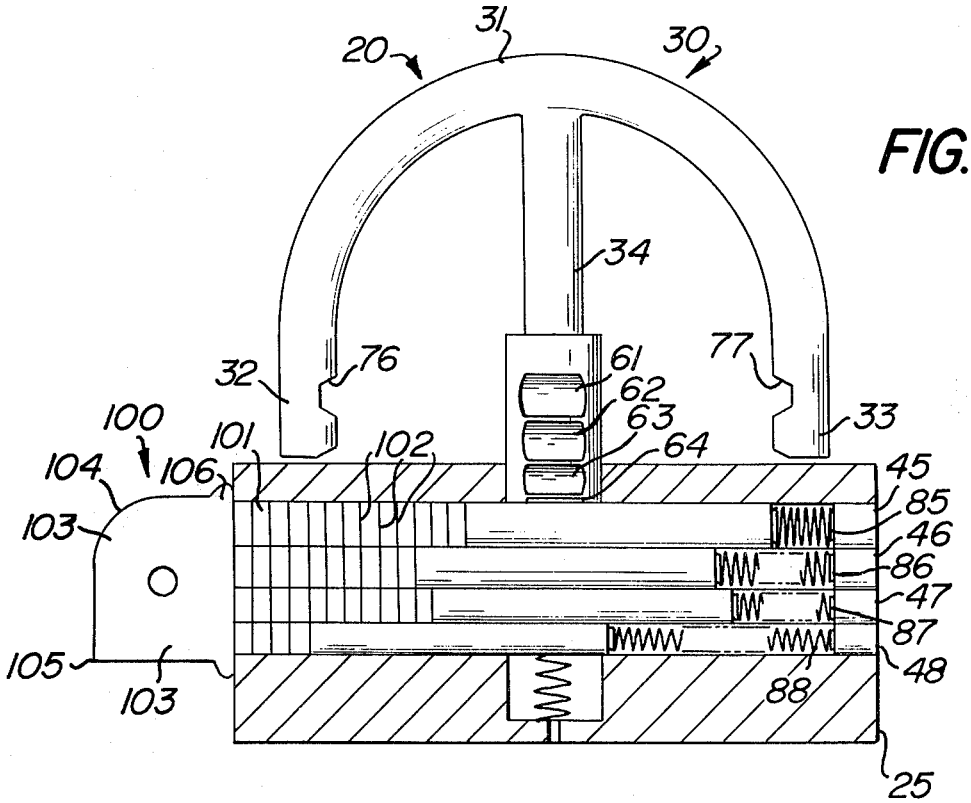
FIG. 2 is a view similar to FIG. 1, but in unlocked condition with an inserted key.

Conformably received in each cylindrical cavity region 41–44 is a conformably configured slidable pin or tumbler, as at 81, 82, 83 and 84, respectively. The cylindrical pins or tumblers 81–84 may be of the same length, as shown in FIGS. 1 and 2, and resiliently biased toward slot 51 by respective springs 85, 86, 87 and 88 interposed between the associated tumbler and its aligned closure or plug 45, 46, 47 and 48. Each of the tumblers 81–85 is provided at a selected location therealong with a notch or cutout, as at 91, 92, 93 and 94. The cutouts 91–94 are all located to face inwardly, away from body surface 26, for a purpose appearing presently.

In FIG. 9 is shown one of the tumbler 81, and its associated biasing means or spring 85. The transverse notch or cutout 91 is also shown in tumbler 81. Suitable means restraining the several tumblers 81–84 against rotation may be provided. One such means may be end slots, as at 95 and 96 in the tumbler 81 and 45, respectively, receiving opposite ends of the intermediate spring 85 to restrain the tumbler against axial rotation.

It will be observed that the several notches 91–94 are out of alignment in the locked condition of FIG. 1. However, the several tumblers can be shifted longitudinally to align their notches 91–94 in position facing toward the intermediate tine 34. Such alignment of the several notches 91–94 may be achieved by insertion through slot 51 of a suitably specifically configured key 100. The key may be inexpensively mass produced, as by stamping from sheet steel, or other inexpensive material. The key 100 may include an insertion part 101, say stamped with a gridwork of break lines 102. This affords convenient selective break away of the insertion part 101 to achieve a unique configuration producing the desired relative shifting movement of the several tumblers 81–84. From the insertion part 101, there may extend a handgrip part 103, which may be asymmetrical, say by a rounded upper corner 104 and square lower corner 105, to indicate the desired orientation for insertion in slot 51. Additionally, there may be provided stop members or lugs 106 for abutting engagement with the body end surface 24 when the insertion part 101 is inserted to proper depth.

Located slidably in each bore or passageway 53 and 54 is a generally cylindrical detent member or pin 110 and 111, respectively. The detent members 110 and 111 may be substantially identical, each including a conical outer end extension, as at 112 and 113, respectively, for extension into and retraction from respective tine recesses 76 and 77. The inner ends of detent members 110 and 111 are provided with tapering end tabs 114 and 115, respectively, both extendable into slot 65 through opposite ends thereof. The taper of end tabs 114 and 115 may correspond to the angle of oblique end wall surfaces 67, 68, 70 and 71.

In the locked condition of FIG. 5, it will be seen that detent members 53 and 54 engage in respective tines 32 and 33 to afford additional security against release. Upon insertion of key 100 to depress tumblers 81–84 properly to align their several semicylindrical cutouts or notches 91–94 adjacent to the intermediate tine 34, the intermediate tine is released for upward withdrawal in its hole 37. It will be observed in FIG. 5 that a small clearance is provided in each recess 76, 77 for its respective received end projection 112, 113. Upon upward movement of the shackle 30, this clearance would be on the upper side of each end extension 112, 113, and between each inner end tab 114 and 115 and its adjacent conformably oblique end surface 67 and 68. This inner end clearance permits slight inward shifting of the detent members 110 and 111, and this procedure continues upon continued upward or outward shackle movement until the detent pins 110 and 111 are retracted to completely withdraw their end extensions 112 and 113 from respective recesses 76 and 77, so that the outer tines 32 and 33 are cleared for opening withdrawal, as well as the intermediate tine 34.

The detent pins 110 and 111 may each be provided with a longitudinal slot, as at 120 and 121, respectively receiving fixed pins 122 and 123, which limit sliding movement of the detent members.

In addition, a pin 124, see FIG. 3, is fixed in the lock body 22 and projects into vertical slot 74 when the shackle is locked. Upon upward withdrawal of the shackle, the withdrawal is limited by engagement of pin 124 in the lower end of slot 74, while rotation of the shackle about the intermediate tine 34 is limited by the angular extent of slot 75 which receives the pin 124. However, prior to engagement of pin 124 in the arcuate slot 75, the end tabs 114 and 115 of the detents 110 and 111 are engaged by the oblique end wall surfaces 70 and 71 to shift the detents outwardly, out of the slot 65 and into the holes 35 and 36. That is, outward shifting of the detent members 110 and 111 is not impaired by the tines 32 and 33, as the latter have been raised or withdrawn beyond the holes 53 and 54.

Of course, upon 90° rotation of the shackle 30, the tines 32 and 33 become accessible for engagement through various objects, as desired, while the intermediate tine 34 is accessible for encirclement by various articles, as desired.

When it is desired to lock the padlock 20, as by inward shifting of the shackle 30, the tumblers 41–44 are necessarily depressed to the aligned condition of their respective notches 91–94, and the shackle tines 32 and 33 inserted inwardly into respective holes 35 and 36. The tine ends may be provided with chamfers or bevels, as at 125 and 126, to engage the respective detent outer end extensions 112 and 113 and shift the detents inwardly out of holes 35 and 36. Continued insertion of the shackle tines 32–34 into their respective holes effects resumption of the locked condition shown in FIG. 5.

Specifically, it will be appreciated that the successively smaller diameters of tumblers 81, 82, 83 and 84, in the downward direction, and their conformably receiving formations, serve certain advantageous purposes, including that of permitting lock closure without key insertion, and assuring full closure of the lock. Thus, with the lock in open position, as shown in FIG. 2, the key may be withdrawn and the lower full diameter region of intermediate tine 34 will be engaged in the several aligned notches 91–94. Further, upon locking movement to further insert the intermediate tine 34 into the lock body, the several tumblers or pins 81–84 are all prevented from returning leftward, as seen in FIG. 2, until each is aligned with its properly sized, respective cutout or formation 61–64. This occurs only when the shackle is fully inserted to its proper locked position. Of course, it is essential that the tumblers be of successively smaller size in the inward direction, as otherwise there would not be assured locking only in the proper shackle position.

It will be observed, as in FIG. 2, that the lowermost tumbler 84 is at all times located with its notch 94 aligned with intermediate tine 34. This serves the anti-picking function of effecting locking upon picking movement shifting the notch 94 out of its normal position. It will also be appreciated that by the relatively narrow keyway or slot 51, and by its location offset from the center line of tumblers 81–84, and entirely out of alignment with the intermediate tine 34, that access for picking is effectively obviated. Of course, an anti-picking tumbler with its notch aligned with the intermediate tine 34, such as tumbler 84, may be located at any tumbler position, as desired.

From the foregoing, it is seen that the present invention provides a padlock construction which is relatively simple, capable of economic mnufacture, highly secure, substantially reduces key cost, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A padlock comprising a body having at least a pair of generally parallel tine-receiving holes, a shackle having at least a pair of generally parallel tines inserted in said holes and shiftable therein between shackle locked and unlocked positions, a plurality of spring biased tumbler pins shiftable in said body transversely intersecting one of said tines to retain the latter in its shackle locked position, said tumblers having notches at selected locations to release said one tine for shifting to its shackle unlocked position upon alignment of the tumbler notches, said body having a key slot for end access to said tumblers to shift the latter and effect said alignment, and a keeper mounted in said body extending between said holes and into said tines to positively retain the latter in said shackle locked position against tampering, said keeper being movably mounted in said body, and coacting tine and keeper surfaces simultaneously urging the keeper on one side and providing clearance on the other side to move the keeper and release said tines to shackle unlocked position.

2. A padlock according to claim 1, said tumblers being generally coplanar and partially intersecting said one tine, and said key slot lying in the plane of said tumblers but outside the plane of said one tine, to deter unauthorized access to the body interior.

3. A padlock according to claim 2, said tumblers each being generally cylindrical.

4. A padlock according to claim 2, said tumblers each being of different cross-sectional configuration, and said one tine being configured to conformably receive the respective different cross-sectional configurations when in said shackle locked position, so that said tumblers can enter said intersecting relation only in the shackle locked position.

5. A padlock according to claim 4, said tumbler cross-sections differing in size.

6. A padlock according to claim 1, said shackle having three generally parallel and substantially coplanar tines, said one tine being medially of the remaining tines.

7. A padlock comprising a body having at least a pair of generally parallel tine receiving holes, a shackle having at least a pair of generally parallel tines inserted in said holes and shiftable therein between shackle locked and unlocked positions, a plurality of spring biased tumblers shiftable in said body transversely intersecting one of said tines to retain the latter in its shackle located position, said tumblers having notches at selected locations to release said one tine for shifting to its shackle unlocked position upon alignment of the tumbler notches, said body having a key slot for end access to said tumblers to shift the latter and effect said alignment, a keeper slidably mounted in said body between and having opposite ends extending transversely into said holes, a laterally open receiver in each tine to receive the adjacent keeper end, one tine receiver extending longitudinally of its tine to permit tine movement with the associated keeper end received, the other tine receiver conforming to the associated keeper end to preclude tine movement with the associated keeper end received, interacting blocking surfaces on said one receiver and associated keeper end to limit tine entry in the locked shackle position so that the keeper end associated with said other receiver remains in the latter while permitting further keeper entry into said one receiver upon unlocking withdrawal of said tines, and interacting cam surfaces on said other receiver and its associated keeper end to effect keeper displacement out of said other tine receiver upon said unlocking tine withdrawal.

8. A padlock according to claim 7, said interacting blocking and cam surfaces being oblique to tine and keeper movement.

9. A padlock according to claim 7, said interacting blocking and cam surfaces affording initial clearance to permit continued unlocking tine withdrawal.

* * * * *